US006398601B1

(12) United States Patent
Oguma

(10) Patent No.: US 6,398,601 B1
(45) Date of Patent: Jun. 4, 2002

(54) TILT STOP MECHANISM FOR OUTBOARD DRIVE

(75) Inventor: Takahiro Oguma, Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/546,272

(22) Filed: Apr. 10, 2000

(30) Foreign Application Priority Data

Apr. 9, 1999 (JP) ..... 11-103368

(51) Int. Cl.[7] ..... B63H 21/26
(52) U.S. Cl. ..... 440/53; 440/55; 440/63
(58) Field of Search ..... 440/53, 55, 56, 440/63, 61, 64, 65

(56) References Cited

U.S. PATENT DOCUMENTS 3,371,893 A * 3/1968 Blanchard, Jr. ..... 440/55
4,099,479 A * 7/1978 Arimitsu ..... 440/55
4,331,430 A * 5/1982 Lutzke et al. ..... 440/53
4,419,083 A * 12/1983 Taguchi ..... 440/56
4,676,757 A * 6/1987 Ruge et al. ..... 440/55
4,726,797 A * 2/1988 Taguchi ..... 440/63
4,759,797 A * 7/1988 Nishimura ..... 440/55
4,863,405 A * 9/1989 Hervat et al. ..... 440/53
4,925,410 A * 5/1990 Boda ..... 440/55
4,930,744 A * 6/1990 Woodard et al. ..... 440/53
4,931,027 A * 6/1990 Nakahama et al. ..... 440/53
5,026,308 A * 6/1991 Sumigawa ..... 440/61
5,052,956 A * 10/1991 Binversie et al. ..... 440/53
5,145,423 A * 9/1992 Kawai ..... 440/63
5,755,603 A * 5/1998 Kumita ..... 440/55
5,799,925 A * 9/1998 Kumita et al. ..... 440/53

* cited by examiner

*Primary Examiner*—S. Joseph Morano
*Assistant Examiner*—Lars A. Olson
(74) *Attorney, Agent, or Firm*—Knobbe, Martens, Olson & Bear, LLP

(57) ABSTRACT

A tilt stop mechanism for an outboard drive assembly includes an improved construction that is easy to handle and can be provided in a relatively narrow space of a support assembly. The support bracket includes a pair of transversely spaced portions. At least a portion of the outboard drive assembly is interposed between the spaced portions. A tilt pin couples the drive assembly to the support bracket for pivotal movement about a tilt axis extending generally horizontally. A tilt stop member is coupled to the drive assembly for pivotal movement about a pivot axis extending generally horizontally. The tilt stop member has at least one stopper portion extending between the drive assembly and the support bracket when the drive assembly is in a tilted-down position. The support bracket has at least one recess. The stopper portion engages with the recess by the pivotal movement of the tilt stop member when the outboard drive is in a tilted-up position.

20 Claims, 12 Drawing Sheets

TILT STOP MECHANISM FOR OUTBOARD DRIVE

PRIORITY INFORMATION

This application is based on and claims priority to Japanese Patent Application No. 11-103368, filed Apr. 9, 1999, the entire contents of which is hereby expressly incorporated by reference.

BACKGROUND OF THE INVENTION

1. Field of the Invention

This invention relates to a tilt stop mechanism for an outboard drive, and more particularly to an improved tilt stop mechanism suitable for an outboard motor.

2. Description of Related Art

Typical marine outboard drives are supported on an associated watercraft for tilting movement about a tilt axis that extends generally horizontally. This movement is usually incorporated in an outboard drive system so as to permit a drive unit of the system to be tilted up from a normal running condition to a raised, out of the water position for storage, service, transport and the like.

One of the typical outboard drive systems is an outboard motor. The outboard motor basically comprises a drive unit and a support assembly that supports the drive unit on the associated watercraft. The support assembly includes a swivel bracket, clamping bracket and a tilt pin. The support assembly supports the drive unit for pivotal movement about a steering axis extending generally vertically. The clamping bracket is affixed to the associated watercraft and the tilt pin couples the swivel bracket to the clamping bracket for pivotal movement about a tilt axis extending generally horizontally. Thus, the drive unit is not only securely supported on the associated watercraft but also is tiltable and steerable.

In order to tilt up the drive unit, the support assembly normally includes a hydraulic power tilt and trim adjustment device, although a small size outboard motor usually does not include such a device. The hydraulic tilt device can tilt up the drive unit and hold it in the tilted up position for a while. However, it is not appropriate to have the device hold the drive unit in the tilted up state for a long time. The outboard motor needs another device to hold the drive unit in the tilted up position for an extended period of time, such as when in storage and when servicing.

Various types of tilt position holding devices are employed for outboard motors. One form of the tilt position holding device is a pin. After tilting the drive unit up, the user or operator simply puts this pin in a certain place of the support assembly. The manner of using the pin is quite simple. On the other hand, however, the operator is likely to lose the pin because it is provided separately from the support assembly. It also requires some skill or experience to handle it. In addition, the pin may have deficiency in strength for supporting the drive unit.

Other types of tilt position holding devices are available. U.S. Pat. Nos. 4,419,083; 4,726,797; 4,759,733 and 5,145,423 disclose examples of such devices. Although these devices can resolve the aforenoted problems, they incorporate relatively complicated mechanisms or need sufficient space for furnishing. Recent outboard motors need compact mechanisms for such a device because a number of control devices and accessories must exist together in a relatively narrow space of the support assembly.

Generally, other marine outboard drives such as stem drive units also require compact mechanisms for holding them in a tilted up position.

A need therefore exists for an improved tilt position holding mechanism that is easy to handle and can be provided in a relatively narrow space of a support assembly.

SUMMARY OF THE INVENTION

In accordance with one aspect of the present invention, a tilt position holding device for an outboard drive assembly comprises a support bracket adapted to be affixed to an associated watercraft. The support bracket includes a pair of transversely spaced portions. At least a portion of the drive assembly is interposed between the spaced portions. A tilt pin couples the drive assembly to the support bracket for pivotal movement about a tilt axis that extends generally horizontally. A tilt stop member is coupled to the drive assembly for pivotal movement about a pivot axis extending generally horizontally. The tilt stop member has at least one stopper portion. The stopper portion extends between the drive assembly and the support bracket when the drive assembly is in a tilted-down position. The support bracket has at least one engage portion. The stopper portion is engageable with the engage portion by the pivotal movement of the tilt stop member when the drive assembly is in a tilted-up position.

In accordance with another aspect of the present invention, a tilt position holding device for an outboard drive assembly comprises a support bracket adapted to be affixed to an associated watercraft. The support bracket includes a pair of transversely spaced portions. At least a portion of the drive assembly is interposed between the spaced portions. A tilt pin couples the drive assembly to the support bracket for pivotal movement about a tilt axis extending generally horizontally. A tilt stop member is coupled to the drive assembly for pivotal movement about a pivot axis extending generally horizontally. The drive assembly has a projection on its side surface. The tilt stop member includes at least one stopper portion that is allowed to position at one of an upper side and a lower side of the projection. The support bracket has at least one holder portion. The stopper portion is engageable with the holder portion by the pivotal movement of the tilt stop member when the stopper portion is positioned at the upper side of the projection so that the tilt stop member holds the drive assembly in a tilted up position.

In accordance with a further aspect of the present invention, a tilt lock mechanism for an outboard drive assembly comprises a support bracket adapted to be affixed to an associated watercraft. The support bracket includes a pair of bracket arms. A tilt pin connects the drive assembly to the support bracket for pivotal movement about a tilt axis extending generally horizontally. An actuator is connected between the drive assembly and the support bracket for pivotal movement about a first pivot axis extending generally horizontally to tilt the drive assembly relative to the support bracket. A tilt lock member is connected to the drive assembly for pivotal movement about a second pivot axis extending generally horizontally. The second pivot axis is generally consistent with the first axis. The tilt lock member includes at least one lock portion. The support bracket has at least one holder portion. The lock portion is engageable with the holder portion by the pivotal movement of the tilt lock member so that the tilt lock member locks the drive assembly in a tilted up position.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention.

FIG. 6(*b*) is a schematic view showing a movement of a stopper portion of a tilt stop member when the drive unit is going to be held at a fully tilted up position.

FIG. 8(*b*) is a side view of the tilt stopper portion. FIG. 8(*c*) is a front view of the tilt stopper portion. FIG. 8(*d*) is a side view of a washer. FIG. 8(*e*) is a side view of a grip portion. FIG. 8(*f*) is a front view of the tilt stop member that is fully assembled.

DETAILED DESCRIPTION OF THE PREFERRED EMBODIMENTS OF THE INVENTION

Figure 1:
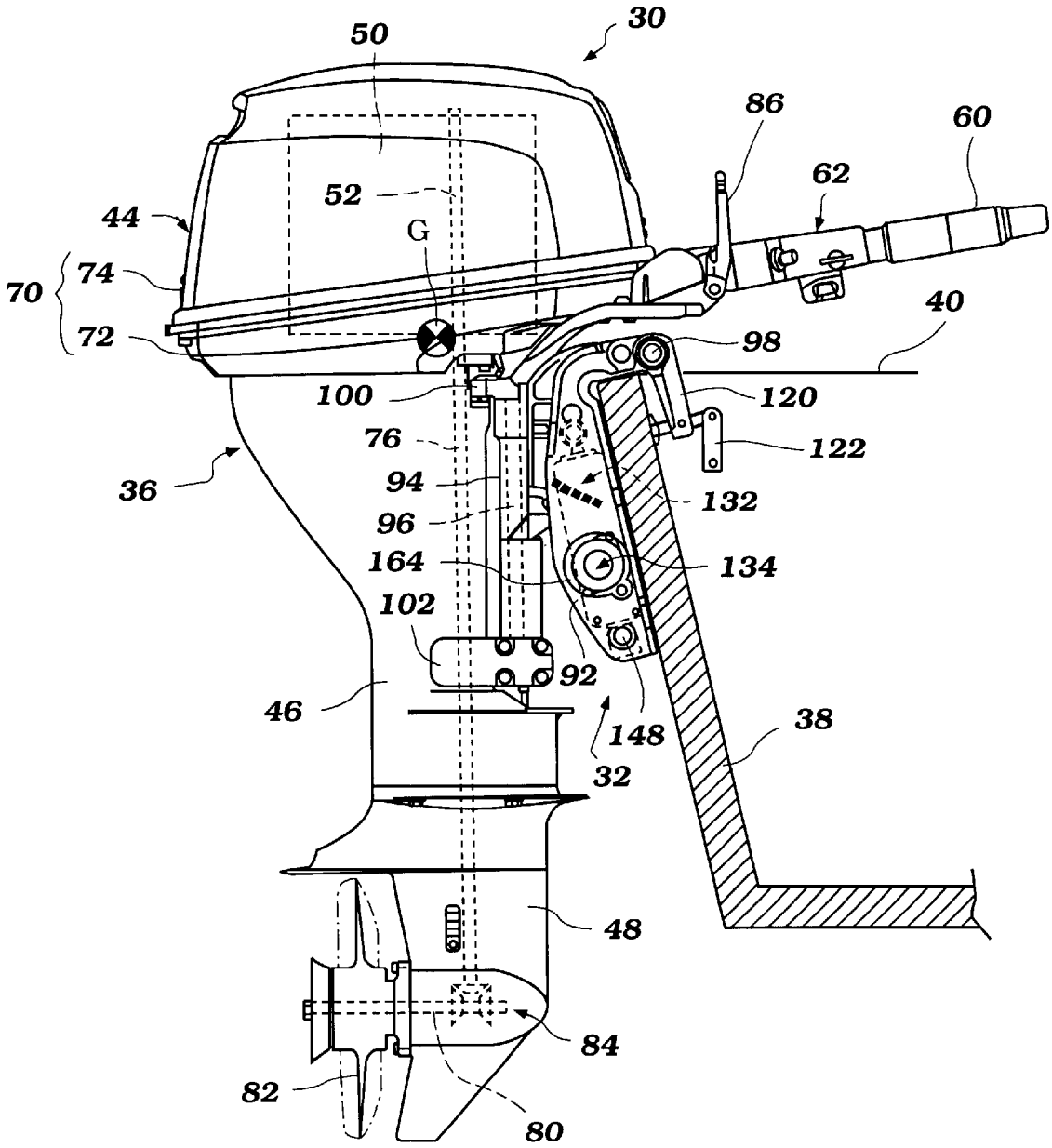
FIG. 1 is a side elevational view of an outboard motor which incorporates a support assembly including a tilt position holding device configured in accordance with a preferred embodiment of the present invention. The outboard motor is illustrated as attached to the transom of an associated watercraft in a fully trimmed down position. The associated watercraft is shown partially and in section.
Figure 2:
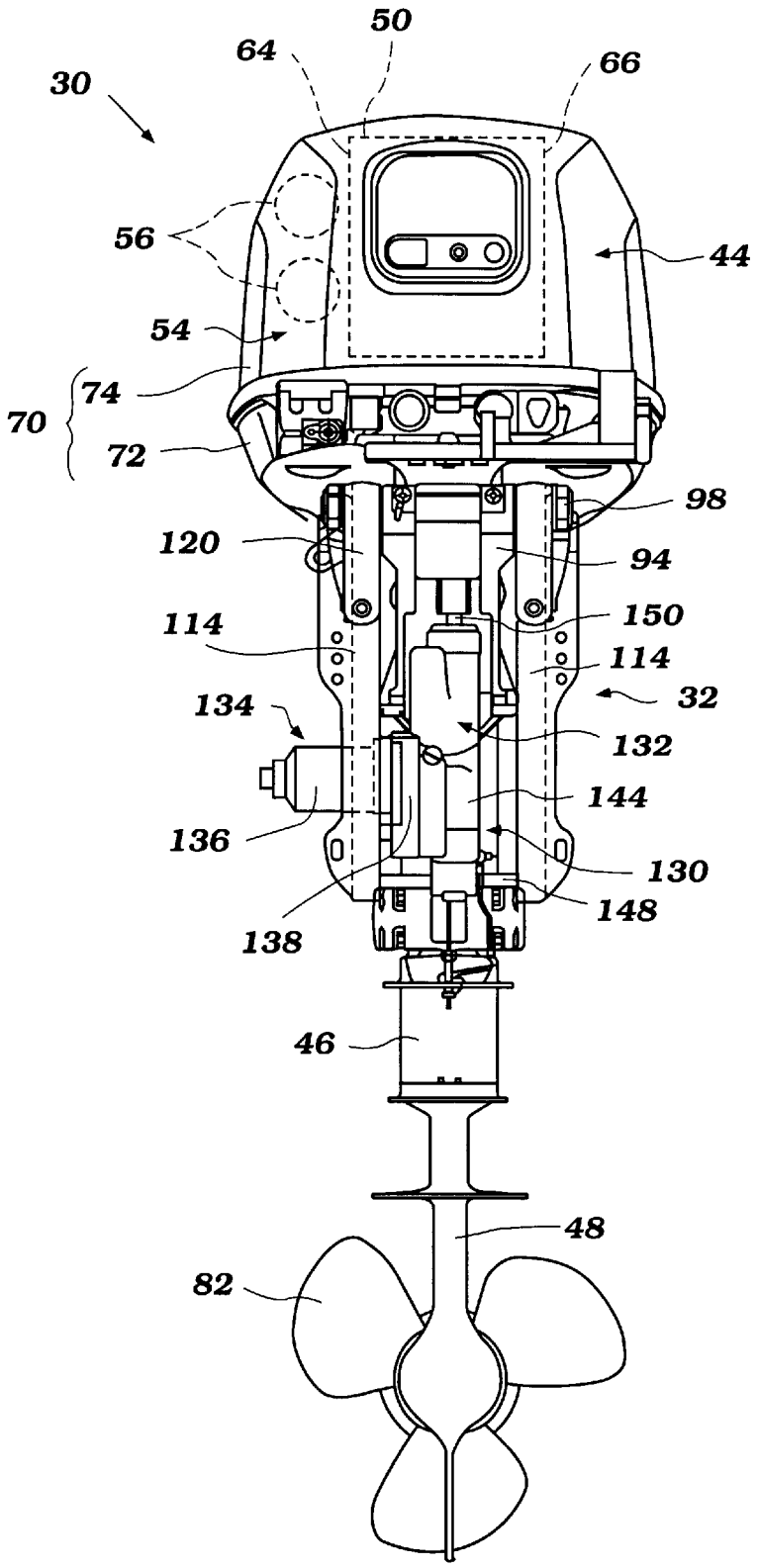
FIG. 2 is a front elevational view of the outboard motor.
Figure 3:
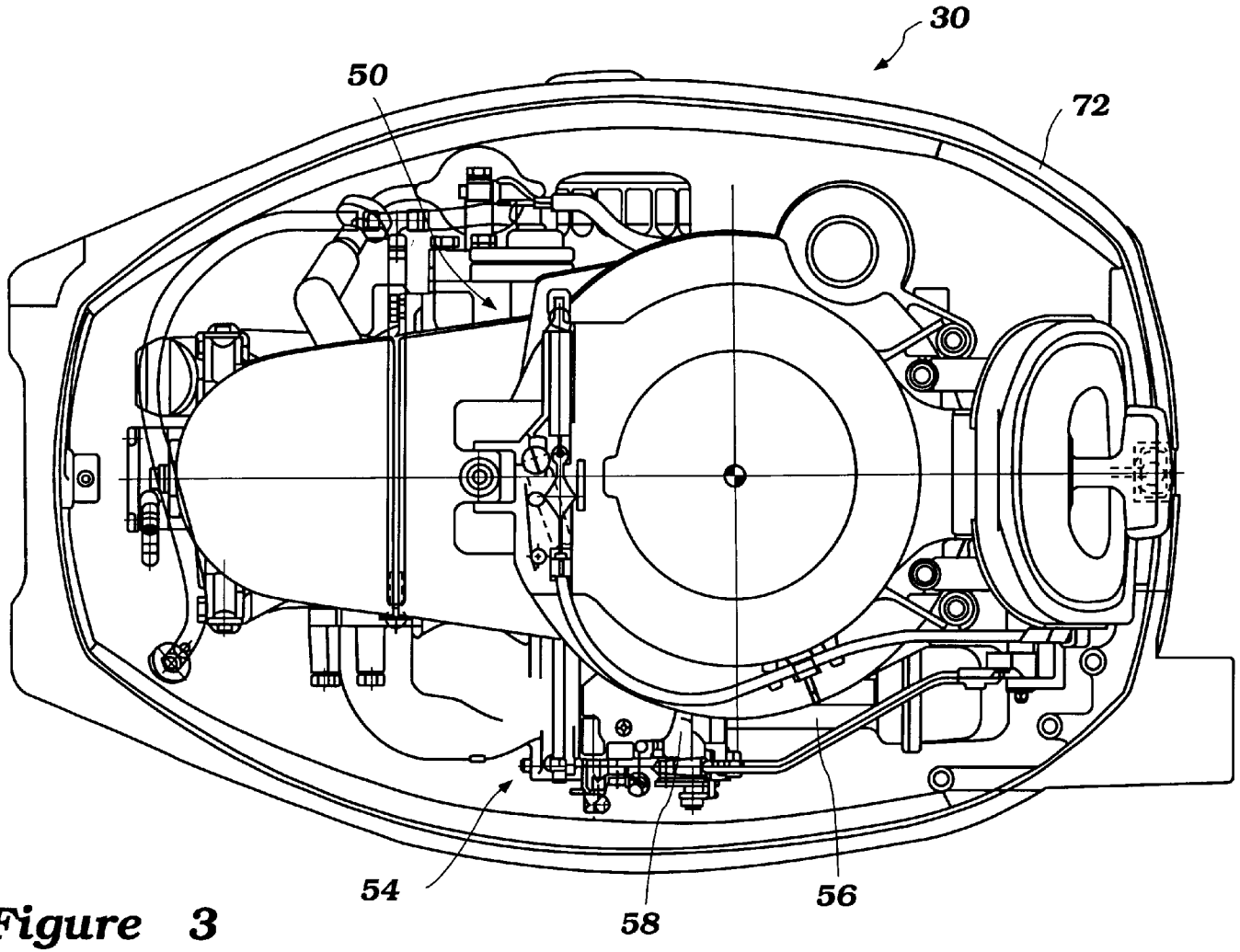
FIG. 3 is a top plan view of the outboard motor. A top protective cowling is detached to show an arrangement of an engine of the outboard motor.

With reference to FIGS. 1 to 3, an exemplary outboard motor 30, which incorporates a support assembly or tilt and trim adjustment system 32 that is a tilt position holding device 34 (see FIG. 7) configured in accordance with a preferred embodiment of the present invention, will be described. Because the present tilt position holding device has particular utility with an outboard motor, the following describes the tilt holding device in connection with such an outboard motor; however, the depiction of the invention in conjunction with an outboard motor is merely exemplary. Those skilled in the art will readily appreciate that the present tilt position holding device can be readily adapted for use with other types and sizes of outboard or marine drives (e.g., a stem drive unit).

In the illustrated embodiment, the outboard motor 30 comprises a drive unit 36 and the support assembly 32 that supports the drive unit 36 on a transom 38 of an associated watercraft 40. An exemplary outboard motor is illustrated in FIG. 1, and the following will initially describe the outboard motor in order to provide the reader with an understanding of the illustrated environment of use.

As used through this description and claims, the terms "front," "forward" or "forwardly" mean at or to the side where the support assembly 32 is located in regard to the drive unit 36 and the terms "reverse," "rearward" or "rearwardly" mean at or to the opposite side of the front side, unless indicated otherwise.

The drive unit 36 comprises a power head 44, a driveshaft housing 46 and a lower unit 48. The power head 44 includes an internal combustion engine 50. In the illustrated embodiment, the engine 50 is a L2 (in-line two cylinder) type and operates on a four-stroke combustion principle. The engine 50 has a cylinder body that defines two cylinder bores generally horizontally extending and spaced generally vertically with each other. A piston can reciprocate in each cylinder bore. A cylinder head is affixed to one end of the cylinder body and defines two combustion chambers with the piston and the cylinder bores. The other end of the cylinder body is closed by a crankcase member that defines a crankcase chamber with the cylinder bores. A crankshaft or output shaft 52 extends generally vertically through the crankcase chamber. The crankshaft 52 is pivotally connected to the pistons by connecting rods and rotates with the reciprocal movement of the pistons.

As seen in FIGS. 2 and 3, the engine 50 includes an air induction device 54 that supplies an air charge to the combustion chambers. The air induction device 54 comprises a pair of air intake ducts 56 and throttle bodies 58 both corresponding to the respective combustion chambers. The air intake ducts 56 are vertically spaced apart from each other and involve the throttle bodies 58 midway thereof. The throttle bodies 58 include throttle valves that measure an amount of an air charge delivered to the combustion chambers in response to various engine-running conditions. The throttle valves are operable by a throttle controller 60 that rotates about an axis of a steering handle 62. The throttle valves have valve shafts that are coupled with the throttle controller 60 in a manner that is well known, for example, by a throttle cable or linkage. The cylinder body has a pair of side surfaces, specifically, a starboard side surface 64 and a port side surface 66, that extend generally along reciprocation axes of the pistons. In the illustrated embodiment, the air intake ducts 56 exist only on a starboard side surface 64.

Although not shown, the engine 50 further includes a fuel supply system that supplies a fuel charge to the combustion chambers for combustion with the air charge, a firing system that fires the air fuel charge in the combustion chambers, and an exhaust system that discharges a burnt charge or exhaust gasses out of the combustion chambers. A lubrication system, an engine cooling system and an electric engine control system are also employed for optimization of the engine operations.

The engine 50 can have any number of cylinders and cylinder arrangements, and can operate on a variety of known combustion principles (e.g., on a two-stroke principle). Since an engine construction and its operations are well known in the art, any further descriptions on them are believed to be unnecessary to permit those skilled in the art to practice the invention.

A protective cowling assembly 70 that completes the power head 44 surrounds the engine 50. The cowling assembly 70 includes a lower tray 72 and a top protective cowling 74. The tray 72 and the cowling 74 together define a compartment which houses the engine 50 with the lower tray 72 encircling a lower portion of the engine 50.

The driveshaft housing 46 depends from the power head 44 and supports a driveshaft 76 which is coupled with the crankshaft 52 and driven thereby. The driveshaft 76 extends generally vertically through the driveshaft housing 46 and is suitably journaled therein for rotation about the vertical axis. The driveshaft housing 46 also defines internal passages which form portions of the exhaust system.

The lower unit 48 depends from the driveshaft housing 46 and supports a propeller shaft 80 which is driven by the driveshaft 76. The propeller shaft 80 extends generally horizontally through the lower unit 48. In the illustrated embodiment, the propulsion device includes a propeller 82 that is affixed to an outer end of the propeller shaft 80 and is driven thereby. The propulsion device, however, can take the form of a dual, counter-rotating propeller system, a hydrodynamic jet, or like propulsion device. A transmission 84 is provided between the driveshaft 76 and the propeller shaft 80. The transmission 84 couples together the two shafts 76, 80 which lie generally normal to each other (i.e., at a 90° shaft angle) with a bevel gear combination.

The transmission 84 has a switchover mechanism to shift rotational directions of the propeller 82 to forward, neutral or reverse. The switchover mechanism is operable by a shift lever 86 that pivots on the steering handle 62. The switchover mechanism is coupled with the shift lever 86 in a manner that is well known, for example, by a shift cable or linkage.

The lower unit 48 also defines an internal passage that forms a discharge section of the exhaust system. At engine speed above idle, the majority of the exhaust gasses are discharged to the body of water surrounding the outboard motor 30 through the internal passage and finally through a hub of the propeller 82, as well known in the art.

Figure 4:
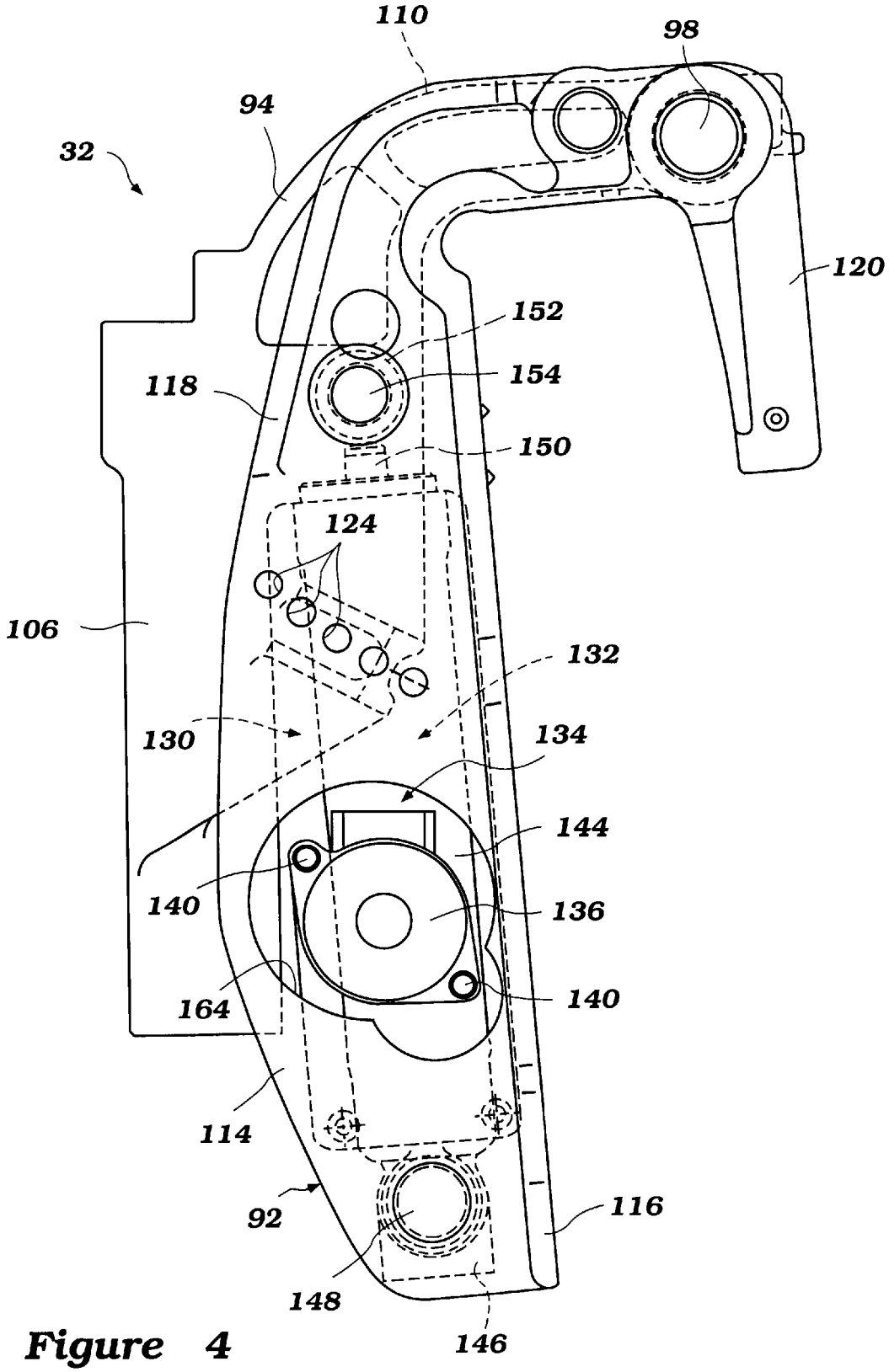
FIG. 4 is an enlarged side elevational view showing the support assembly.

Still with reference to FIGS. 1 to 3 and additionally with reference to FIGS. 4 and 5, a fundamental construction of the support assembly 32 will be described.

The support assembly 32 supports the drive unit 36 on the watercraft transom 38 so as to place the propeller 82 in a submerged position with the watercraft 40 resting on the surface of a body of water. The support assembly 32 generally comprises a clamping bracket or support bracket 92, a swivel bracket 94, a steering shaft 96 and a tilt pin 98.

The steering shaft 96 is affixed to the drive shaft housing 46 through an upper mount assembly 100 and a lower mount assembly 102. An elastic isolator connects each mount assembly 100, 102 to the drive shaft housing 46 (or to a section of the drive unit 36 connected to the drive shaft housing 46, e.g., an exhaust guide member located beneath the engine 50). The elastic isolators permit some relative movement between the drive shaft housing 46 and the steering shaft 96 and contain damping mechanisms for damping engine vibrations transmitted from the drive shaft housing 46 to the steering shaft 96.

The steering shaft 96 is rotatably journaled for steering movement about a steering axis within the swivel bracket 94. The aforenoted steering handle 62 is attached to an upper end of the steering shaft 96 to steer the drive unit 36, in a known manner. Movement of the steering handle 62 rotates the steering shaft 96, as well as the drive shaft housing 46 which is connected through the upper and lower mount assemblies 100, 102 about the steering axis.

The swivel bracket 94 includes a cylindrical housing 106 through which the steering shaft 96 extends. A plurality of bearing assemblies journal the steering shaft 96 within the cylindrical housing 106. The swivel bracket 94 includes a pair of side arms 108 (see FIG. 5) that are positioned in front of the cylindrical housing 106 and project toward the clamping bracket 92.

The swivel bracket 94 also includes a pair of lugs 110 which project forward toward the watercraft transom 38. Each lug 110 includes a coupling hole at its front end. The coupling holes are aligned with each other along a common pivot axis.

As seen in FIG. 1, the clamping bracket 92 is affixed to the transom 38. The clamping bracket 92 includes a pair of bracket arms 114. Each bracket arm 114 has a support plate section 116 and a flange section 118. The plate sections 116 abut the outer surface of the transom 38 when the clamping bracket 92 is attached to the watercraft 40. The flange sections 118 project toward the drive unit 36 from the sides of the plate sections 116. The flange sections 118 are transversely spaced apart from each other by a sufficient distance to receive the swivel bracket 94 therebetween. The flange sections 118 shield the space between the plate sections 116 and the cylindrical housing 106 of the swivel bracket 94 to protect the inner components of the support assembly 32 that will be described shortly.

The clamping bracket 92 further includes a pair of overhang sections 120 extending from the respective flange sections 118. The overhang sections 120 are hanged over a top surface of the transom 38 to stay on the inner wall thereof. Securing members 122 having screwed type fasteners are provided to fix the overhang sections 120 to the inner wall of the transom 38.

The clamping bracket 92 further has a plurality of holes 124 on both of the flange sections 118. A trim pin that determines the most lowered position of the swivel bracket 94 can be selectively positioned at one of the holes 124 if necessary.

The tilt pin 98 completes the hinge coupling between the clamping bracket 92 and the swivel bracket 94. The tilt pin 98 extends through the aligned coupling holes of the clamping bracket 92 and the lugs 110 of the swivel bracket 94 and is affixed to the clamping bracket 92. The inner surfaces of the coupling holes existing through the lugs 110 of the swivel bracket 94 act as bearing surfaces as the swivel bracket 94 rotates about the tilt pin 98. The drive unit 36 thus can be pivoted about the tilt axis defined by the tilt pin 98, through a continuous range of trim positions. In addition, the pivotal connection permits the drive unit 36 to be trimmed up or down in a trim adjustment range, as well as to be tilted up or down in a tilt range. The trim adjustment range includes a fully trimmed down position to a fully trimmed up position, while the tilt range continuously extends above the trim adjustment range and includes a fully tilted down position (i.e., the filly trimmed up position) to a fully tilted up position, as known in the art.

As used through this description and claims, the term "outboard assembly" designates a combination of the drive unit 36 and the swivel bracket 94 in regard to the clamping bracket 92. Because these components in this combination can tilt as a unit.

In the illustrated embodiment, the support assembly 32 also includes a hydraulically operated tilt and trim adjustment mechanism 130. As best seen in FIGS. 4 and 5, the tilt and trim mechanism 130 includes a hydraulic actuator assembly 132 that is nested between the respective bracket arms 114, and operates between the clamping bracket 92 and the swivel bracket 94 to effectuate the tilt and trim movement of the drive unit 36. An upper portion of the mechanism 130 is interposed between the side arms 108 of the swivel bracket 94. While the present embodiment is described in the context of a hydraulic system, other types of working fluids (e.g., air, nitrogen) can also be used.

The tilt and trim adjustment mechanism 130 further includes a powering assembly 134 that is located adjacent to the hydraulic actuator assembly 132. The powering assembly 134 includes a reversible electric motor 136 and a reversible hydraulic pump 138. Although any type of pump is applicable, a conventional gear pump is one of preferred pumps. In the illustrated embodiment, the pump 138 is unified with the actuator assembly 132 in a common jacket, and the motor 136 is affixed to the jacket at its flange portions with screws 140. A rotary shaft of the pump 138 is coupled to an output shaft of the motor 136 so as to be driven thereby. The pump 138 communicates with a fluid reservoir that is formed in the common jacket. In addition, a suitable hydraulic circuit which is also defined in the jacket links the pump 138 to the actuator assembly 132. Any conventional hydraulic circuit can be applied inasmuch as it complies with functions that are required to the tilt and trim adjustment mechanism 130. For instance, one of the typical hydraulic circuits is described in U.S. Pat. No. 5,049,099.

The actuator assembly 132 includes a cylinder 144 having a lower trunnion 146 with a bore that receives a pivot pin 148 to provide a pivotal connection to a lower portion of the clamping bracket 92, and specifically to the bracket arms 114.

An actuator arm or rod 150, which projects beyond an upper end of the cylinder 144, also has an upper trunnion 152 with a bore. The bore of the trunnion 152 receives a pivot pin 154 that pivotally connects the actuator rod 150 to the side arms 108 of the swivel bracket 94 and therebetween via the pivot pin 154.

The cylinder 144 has a closed bottom at its lower end. The other end where the rod 150 projects is closed with a cap having a hole through which the rod 150 can reciprocate. That is, the cap slidably holds the rod 150 via a proper sealing member.

A piston 158 is disposed within the cylinder 144 and slides axially therein. A lower end of the actuator rod 150 is affixed to the piston 158, as seen in FIG. 5. The piston 158 includes one or more O-rings to inhibit leakage of working fluid across the piston 158. In this manner, the piston 158 divides the inner space within the cylinder 144 into an up variable-volume fluid chamber or lower chamber, which is located below the piston 158, and a down variable-volume fluid chamber or upper chamber 160, which is located above the piston 158. Since FIG. 5 illustrates that the piston 158 is placed at the lowermost position, the up variable-volume fluid chamber is not formed below the piston 158. When the piston 158 is positioned here, the rod 150 is nearly confined within the cylinder 144 and the drive unit 36 is placed at the fully trimmed down position. The piston 158 also can include a suitable pressure relief mechanism that allows fluidic communication between the chambers under abnormal operating conditions, as well known in the art.

Figure 5:
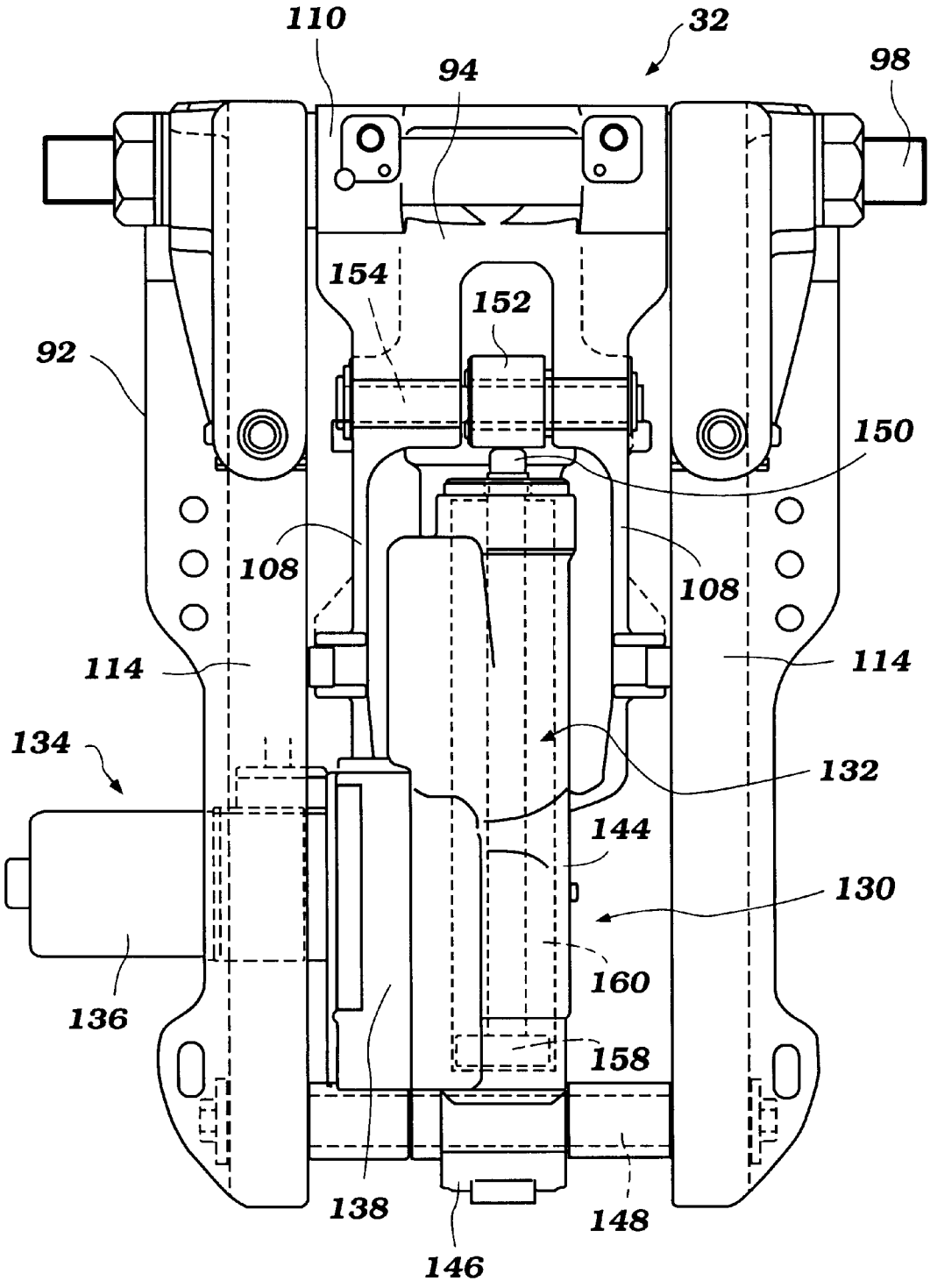
FIG. 5 is an enlarged front view showing the support assembly.

As best seen in FIG. 5, the hydraulic actuator assembly 132 is arranged such that its stroke axis lies generally within a central plane that bifurcates the support assembly 32 and the drive unit 36. Thus, the cylinder 144 lies nested between the bracket arms 114 with the arms 114 symmetrically arranged with respect to the cylinder 144. In the illustrated embodiment, the cylinder 144 also lies symmetrically positioned between the side arms 108 of the swivel bracket 94. In this manner, the stroke axis of the cylinder 144 is positioned generally within the same plane in which the overall center of gravity of the drive unit 36 and the support assembly 32 is located. FIG. 1 also shows the center of gravity in this side view with the reference letter G.

The powering assembly 134 is located on a relatively lower portion of the cylinder 144. That is, the powering assembly 134 is located near an interaction point between the cylinder 144 and the clamping bracket 92 rather than an interaction point between the actuator rod 150 and the swivel bracket 94 (e.g., near the lower trunnion 146).

The powering assembly 134 projects from the actuator assembly 132 in the lateral direction and beyond one of the bracket arms 114 that exists on the starboard side. The bracket arm 114 on this side, therefore, has a through-hole 164 (see FIG. 4). The hole 164 is formed on the flange section 118 of this arm 114. At least the motor 136 protrudes through the hole 164 in this arrangement. The axis of the motor output shaft and the pump shaft desirably lie generally normal to the stroke axis of the cylinder 144. A diameter of the through-hole 164 is greater than at least a diameter of an in-portion of the powering assembly 134 that exists within the hole 164.

A center of the through-hole 164 is off set rearwardly from a center of the in portion of the powering assembly 134, i.e., the motor 136, in the illustrated embodiment. This is because the center of the powering assembly 134 moves slightly rearwardly when the actuator assembly 132 operates. More specifically, with reference to FIG. 4, the pivot pin 154 of the actuator rod 150 moves upwardly and rearwardly around the tilt pin 98 when the swivel bracket 94 rotates clockwise, i.e., the drive unit 36 is going to be tilted up. With this movement, the cylinder 144 pivots around the pivot pin 148 anti-clockwise and hence the center of the powering assembly 134 moves rearwardly.

The protrusion of the powering assembly 134 will be a good sign for indicating the user to recognize that this side should not be put down toward the ground. This is useful not only for preventing the powering assembly 134 itself from being damaged but also for the air induction device 54 from having fuel and/or lubricant therein which may accumulate in the induction device 54 if the device 54 is placed downwardly. As described above, in the illustrated embodiment, the air induction device 54 extends on the same side. Thus, when the outboard motor 30 is so placed to direct the powering assembly 134 upwardly, the air induction device 54 can never be placed downwardly, and the fuel and/or lubricant will not accumulate therein. Accordingly, no fuel and/or lubricant can flow into the combustion chambers from the air induction device 54.

The pump 138 includes a pair of outlet ports that communicate with inlet ports formed in the cylinder 144. As aforedescribed, the outer housings of the assemblies 132, 134 are common in the illustrated embodiment. However, it should be noted that the assemblies 132, 134 may comprise separate pieces that are affixed to each other. By having interfitting ports, the necessity for providing external conduits is avoided and the construction is more compact.

To trim or tilt up the drive unit 36, the pump 138 is driven by the motor 136 in a certain direction that causes the working fluid to be supplied to the lower chamber of the cylinder 144. The fluid pressurizes the piston 158 to move upwardly and hence the actuator rod 150 goes out of the cylinder 144. This movement of the actuator rod 150 lifts up the drive unit 36 to a desired trimmed or tilted up position. With this action of the actuator assembly 132, the powering assembly 134 slightly moves rearwardly. However, the center of the powering assembly 134 is initially set forwardly in regard to the center of the through-hole 164, as noted above. The flange section 118 of the bracket arm 114, therefore, will not prevent the powering assembly 134 from moving rearwardly.

Figures 6A, 6B:
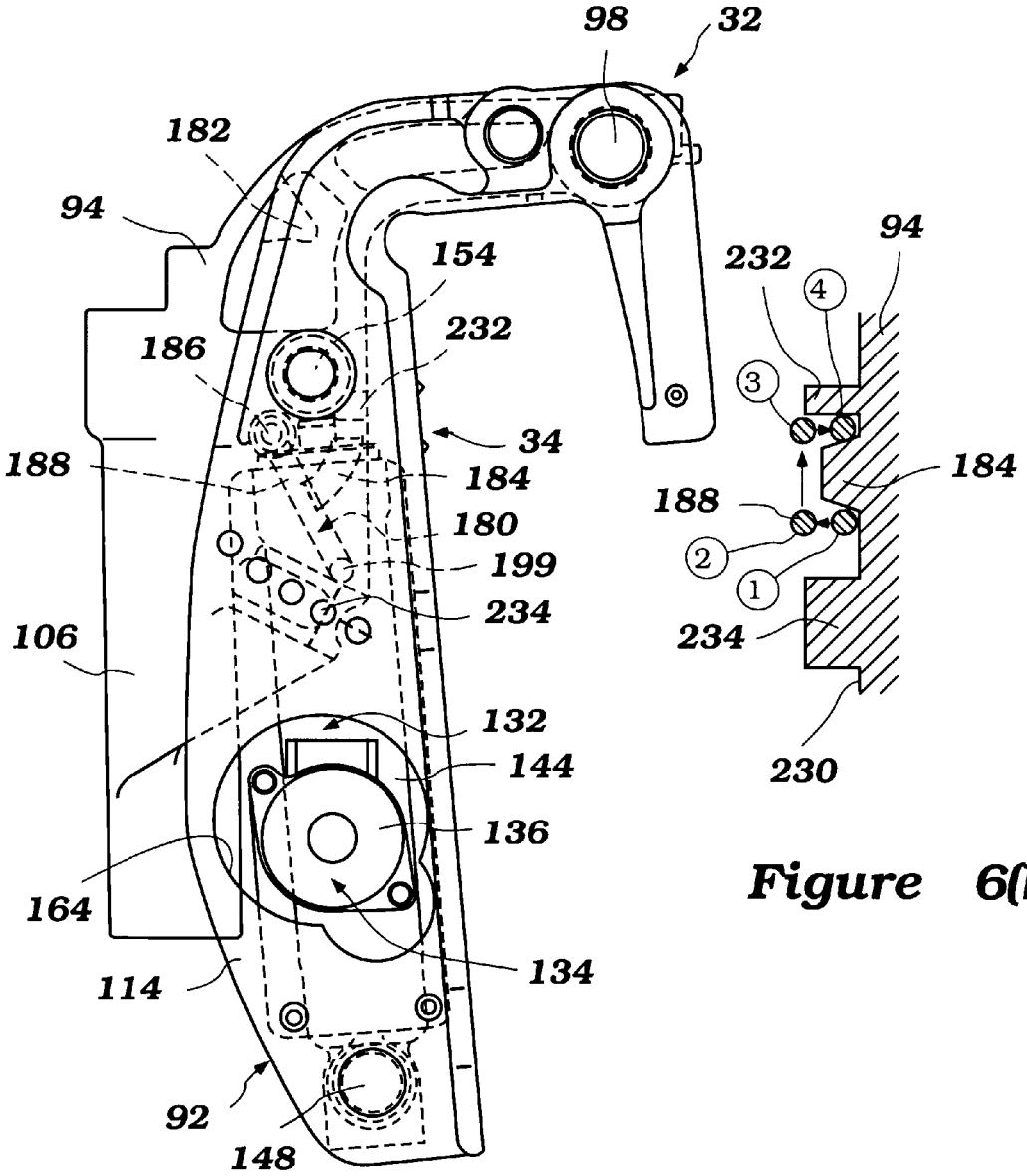
FIG. 6(*a*) is a side elevational view of the support assembly to show particularly a tilt stop mechanism of the embodiment.

The user of the outboard motor 30 may want to place the drive unit 36 at the fully tilted up position for storage, service, transport or the like. For this purpose, the tilt position holding device 34 is provided. With reference to FIGS. 6 (*a*) to 9, the tilt position holding device 34 will be described in great detail.

The tilt position holding device (tilt stop or tilt lock mechanism) 34 generally comprises a tilt stop or tilt lock member 180 and recesses or engage portions 182 formed on the clamping bracket 92, more specifically, the flange portions 118 of the bracket arms 114. In the illustrated embodiment, a projection or position-determining portion 184 is provided additionally.

The tilt stop member 180 is illustrated in FIG. 8 (*f*) in an enlarged front view. The tilt stop member 180 is generally formed with a pin portion 186 that is best seen in FIG. 8 (*a*), a pair of stopper or lock portions 188 that is best seen in FIGS. 8 (*b*) and (*c*), and a grip portion 190 that is best seen in FIG. 8 (*e*).

The pin portion 186 includes a columnar bar section 192 and a pair of slightly narrowed end sections 194, 195. One of the end sections 195 is longer than the other section 194. Each end section 194 is partly cut out for preventing the stopper portion 188 from pivoting after assembly. The longer end section 195 has a male screw thereon except for the cutout portion.

Both of the stopper or lever portions 188 are configured as the same shape. Each stopper portion 188 is formed with a metal sheet 196 and a columnar bar 198 welded together to each other. The lower end of the bar 198 is curved so as to form an engage section 199 that can fit and stay securely in the recess 182 of the clamping bracket 92. A through-hole 200 is formed on the opposite end of each stopper portion. The hole 200 is configured to fit to the cutout of the end section 194 of the pin portion 186.

The grip portion 190 is also formed with a metal sheet 202. A grip or knob 204 is put thereon. A through-hole 206 that has the same configuration as the through-hole 200 is formed on the grip portion 190.

The grip portion 190 is mounted and welded on the shorter end section 194 of the pin portion 186 and further one of the stopper portions 188 is mounted on the pin portion 186 outward of the grip portion 190 and welded to the end section 194 also. Thus, the pin portion 186, grip portion 190 and one of the stopper portions 188 are previously sub-assembled.

Other elements employed for forming the tilt stop member 180 are shown in FIG. 8 (*f*). In the illustrated embodiment, a washer 208, a pair of bushes 214, a coil spring 216 and nuts 218, 220 are provided. The washer 208 is also shown in FIG. 8 (*d*) and has a through-hole 210 configured in the same shape as the through-hole 200. Each bush 214 is made of synthetic resin and has a flange. The flange acts as a retainer for the spring 216 or abuts the washer 208 after fully assembled. The coil spring 216 is configured as a trapezoid in this embodiment. The nut 220 is somewhat configured specially so as to have a female screw therein that is slightly longer than a regular nut.

Figure 7:
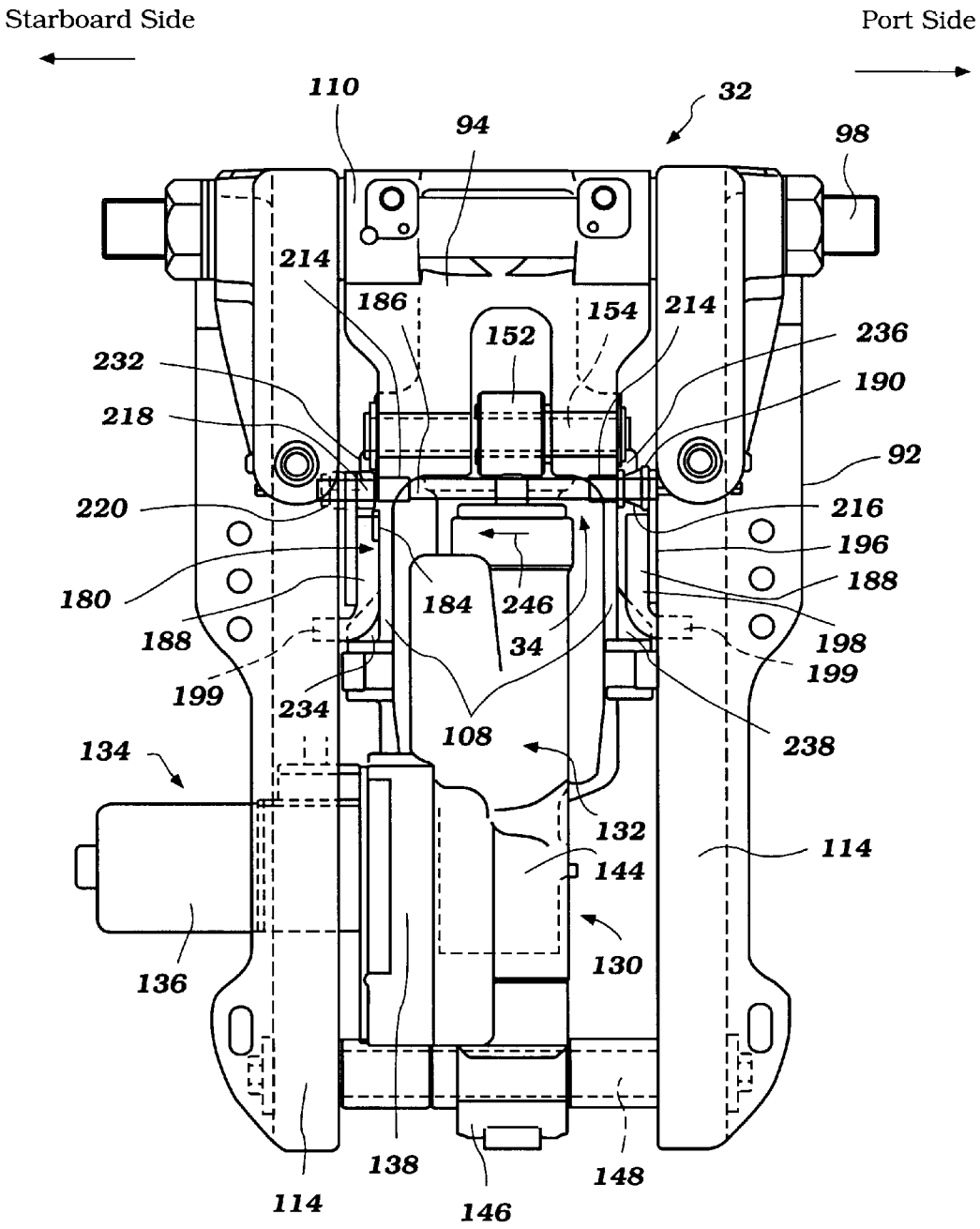
FIG. 7 is an enlarged front view showing the support assembly with the tilt stop mechanism.
Figure 8E:
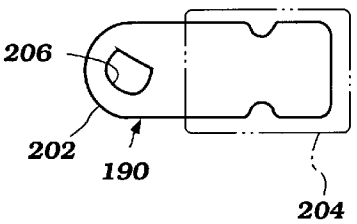
FIG. 8(*a*) is a front view of a pin portion o the tilt stopper member.
Figure 8C:
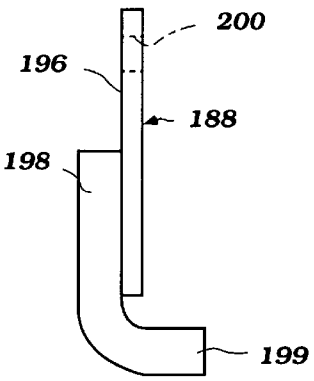
Figure 8B:
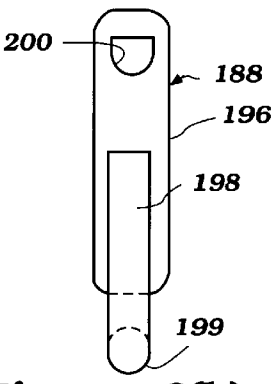
Figure 8D:
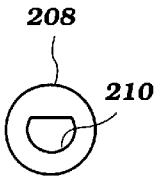
Figure 8A:
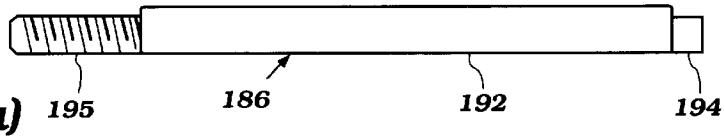
Figure 8F:
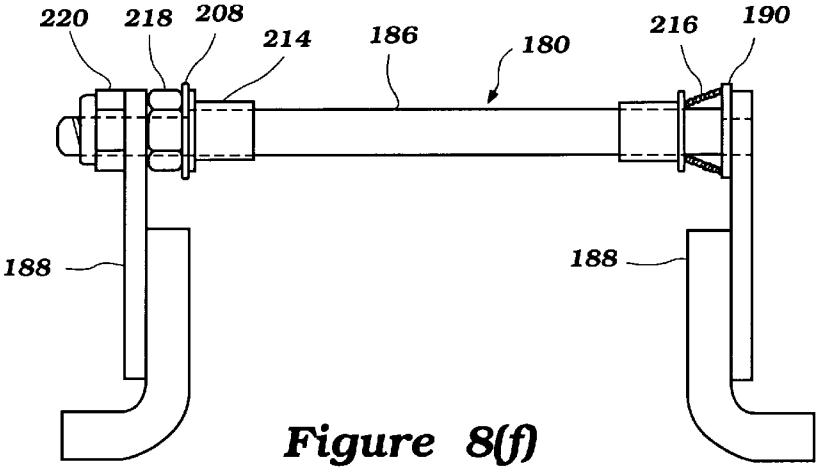

The respective side arms 108 of the swivel bracket 94 have aligned holes to receive the pin portion 186 for pivotal movement. As seen in FIG. 7, the sub-assembled stop member 180 as noted above is passed through the holes so as to be supported thereby. One of the bushes 214 and the spring 216 are previously provided on this sub-assembly. The bush 214 lies on the bar section 192 of the pin portion 186 and its flange 214 acts as a stopper so that the bush 214 is retained at an open end of the hole. The spring 216 is interposed between the flange of the bush 214 and the grip portion 190. The other bush 214 is then mounted on the other end of the bar section 192 of the pin portion 186 and its flange acts as a stopper also. The washer 208 is inserted onto the end section 195 and the nut 218 is used to tighten the elements that have been mounted. The other stopper portion 188 is mounted on the end section 195 and the other nut 220 completes the full assembly of the tilt stop member 180. As seen in FIG. 7, both of the stopper portions 188 extend from the pin portion 186 between the swivel bracket 94 and the clamping bracket 92 to generally form crank configurations together with the pin portion 186. Incidentally, the knob 204 is omitted in FIG. 7.

As assembled, the pin portion 186 is supported by the side arms 108 of the swivel bracket 94. More specifically, the pin portion 186 is retained in the respective bushes 214 for pivotal movement and also slidable along its own axis. The spring 216 biases the pin portion 186 toward the port side (right-hand side in FIG. 7) so that the stopper portion 188, i.e., the bar 198, on the starboard side (left-hand side in FIG. 7) abuts the side arm 108 on the same side. FIG. 7 illustrates this situation. A gap larger than a height of the projection 184 is defined on the other side between the side arm 108 and the stopper portion 188. The position where the pin portion 186 is disposed is the proximity to the pivot pin 154 that supports the upper trunnion 152 of the actuator rod 150.

As best seen in FIG. 6 (*b*), an outer surface 230 of the swivel bracket 94 on the starboard side has the projection 184 that has been described above. In addition to this projection 184, an upper projection 232 a lower projection 234 are further provided generally above and bellow the projection 184 on this side surface. Meanwhile, another outer surface on the port side has only an upper projection 236 and a lower projection 238. Both of the upper projections 232, 236 have generally the same configurations. Also, both of the lower projections 234, 238 have generally the same configurations.

The middle projection 184 is formed as an arc shape so that any point of this projection 184 exists at the same length from the axis of the pin portion 186. The middle projection 184 is a position-determining portion that defines an operative position and a release position of the tilt stop member 180. The operative position is defined at the upper side of the middle projection 184 and between the middle and upper projections 184, 232, while the release position is defined at the lower side of the middle projection 184 and between the middle and lower projections 184, 230. The stopper portion 188 normally stays in the release position and can move to the operative position by climbing over or surmounting the middle projection 184 when the operator operates the grip portion 190 as indicated with the arrow 240 in FIG. 9.

When the swivel bracket 94 is placed at the fully trimmed down position, the stopper portion 188 on the starboard side abuts a lower side surface of the middle projection 184 and the respective engage sections 199 are positioned on each upper side surface of the lower projections 234, 238.

As noted above, both inner surfaces of the flange sections 118 of the bracket arms 114 are provided with the recesses 182 that can receive the respective engage sections 199 when the swivel bracket 94, i.e., the drive unit 36, stays at the fully tilted up position. The flange sections 118 of the bracket arms 114 also have depressions so that these sections 118 do not prevent the engage sections 199 from moving within the trim and tilt range. The depressions are, therefore, forms along loci of the engage sections 199.

Figure 9:
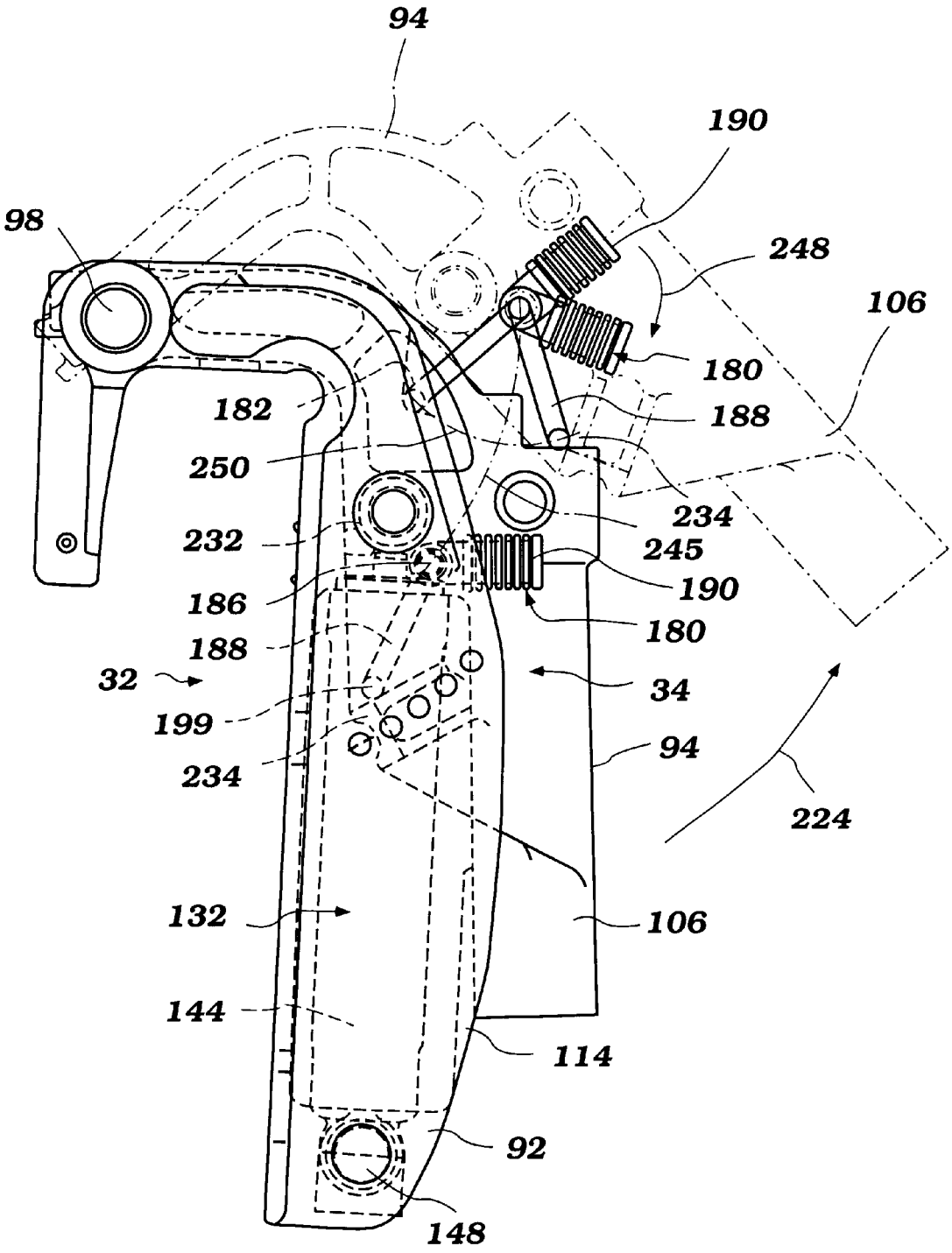
FIG. 9 is an enlarged side elevational view of the support assembly including the tilt stopper member and showing how the tilt stop member moves while the swivel bracket is shifted in a trim and tilt range. The support assembly in the tilted up position is illustrated in phantom line.

The swivel bracket 94 is rotated anti-clockwise as indicated by the arrow 244 of FIG. 9 by the actuator assembly 132. With this movement, the axis of the pin portion 186 of the tilt stop member 180 moves along a locus indicated with the phantom line 245. The aforenoted recesses 182 are placed between the tilt axis of the tilt pin 98 and this locus 245. Because the stopper portions 188, when positioned in the recesses 182, can securely support the drive unit 36 within the area.

When the user or operator wants to hold the drive unit 36 at the fully tilted up position, he or she shifts the pin portion 186 toward the starboard side (the left-hand side in FIG. 7) against the biasing force of the spring 216 by operating the grip 190 as indicated by the arrow 246 of FIG. 7 and then rotates the grip 190 clockwise as indicated with the arrow 248 of FIG. 9 so as to engage the engage sections 199 with the recesses 182 on the bracket arms 114 of the clamping bracket 92.

The shift and rotational movements allow the stopper portion 188 on the starboard side to surmount the middle projection 184. After surmounting the middle projection 184, the user releases grip portion 190 so that the pin portion 186 may slide toward the port side and its initial position by the biasing force of the spring 216. The stopper portion 188 is, therefore, transferred to the operative position that is formed between the middle projection 184 and the upper projection 232 as seen in FIG. 6 (*b*). The arrows shown in FIG. 6 (*b*) indicate the sequential movement of the stopper portion 186. The stopper portion 186 moves in order of the circled reference numeral 1 to 4. A locus of the engage sections 199 is indicated with a phantom line 250 in FIG. 9.

Before the engage sections 199 engage with the recesses 182 completely, the swivel bracket 94 is slightly over-lifted and then lowered down. By completing the engagement of the engage sections 199 with the recesses 182, the tilt stop member 180 can hold the swivel bracket 94 as well as the drive unit 36 at the fully tilted up position. Because the recesses 182 are positioned between the tilt axis of the tilt pin 98 and the locus 245 of the pin portion 186 as noted above.

To trim or tilt down the drive unit 36, the user returns the tilt stop member 180 to its initial position with its inverse movement. The motor 136 then, drives the pump 138 in an opposite direction that causes the working fluid to be supplied to the upper chamber 160 of the cylinder 144. The fluid pressurizes the piston 158 to move downwardly and hence the actuator rod 150 is drawn back into the cylinder 144. This movement of the actuator rod 150 lowers the drive unit 36 down to a desired trimmed or tilted down position.

It should be noted that the actuator assembly 132 can be positioned upside down in regard to the support assembly 32. In this alternative connection, the trunnion 146 of the cylinder 144 is coupled with the pivot pin 154 and the trunnion 152 of the actuator rod 150 is coupled with the pivot pin 148.

As described above, in the illustrated embodiment, the tilt stop member 180 having the stopper portions 188 is pivotally mounted on the side arms 108 of the swivel bracket 94. The stopper portions 188 extend between the swivel bracket 94 and the clamping bracket 92. The clamping bracket 92 has recesses 182 that receive the stopper portions 188. Because of this simplicity, the tilt stop member 180 is easy to handle and can be furnished in a relatively narrow space of the support assembly 32.

Figure 10:
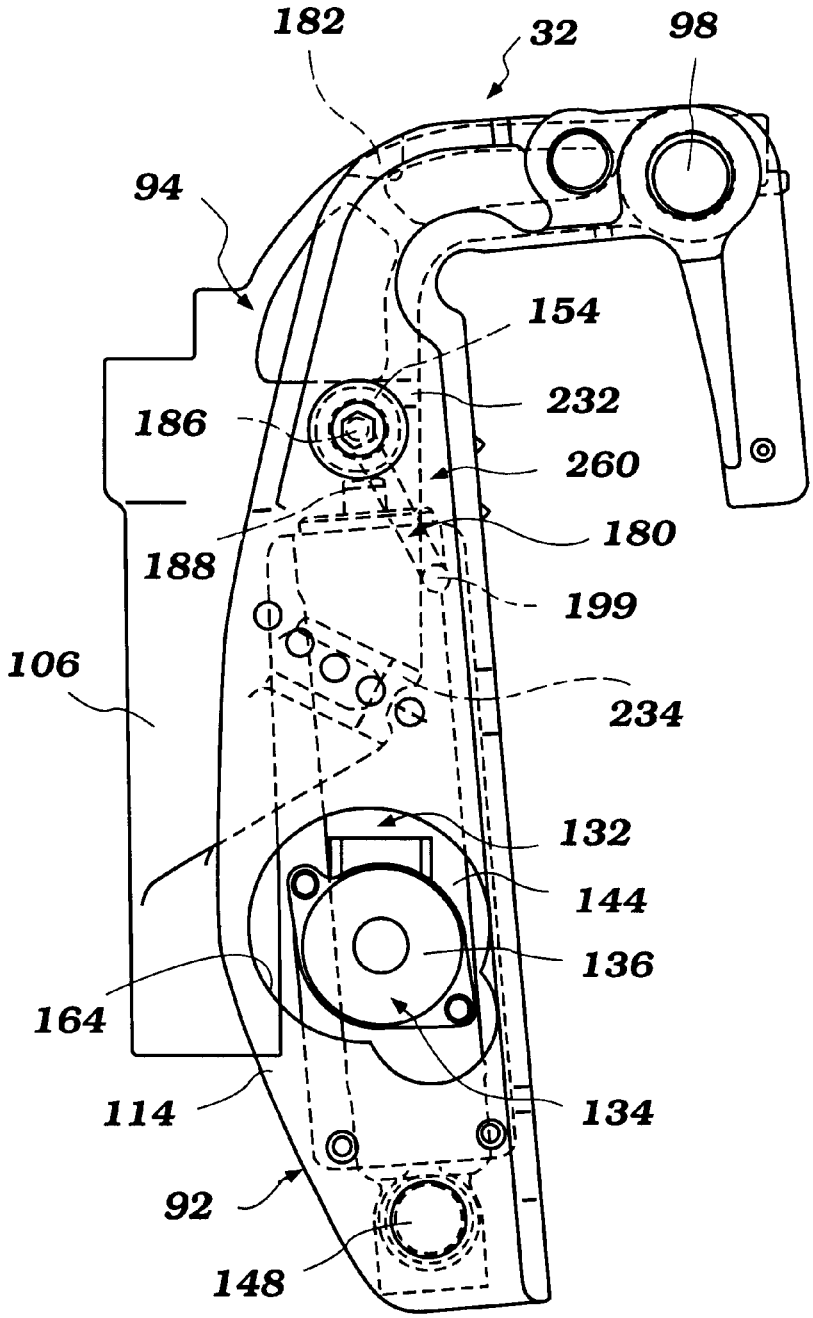
FIG. 10 is an enlarged side elevational view showing another support assembly with a similar tilt stop mechanism configured in accordance with another preferred embodiment of the present invention.
Figure 11:
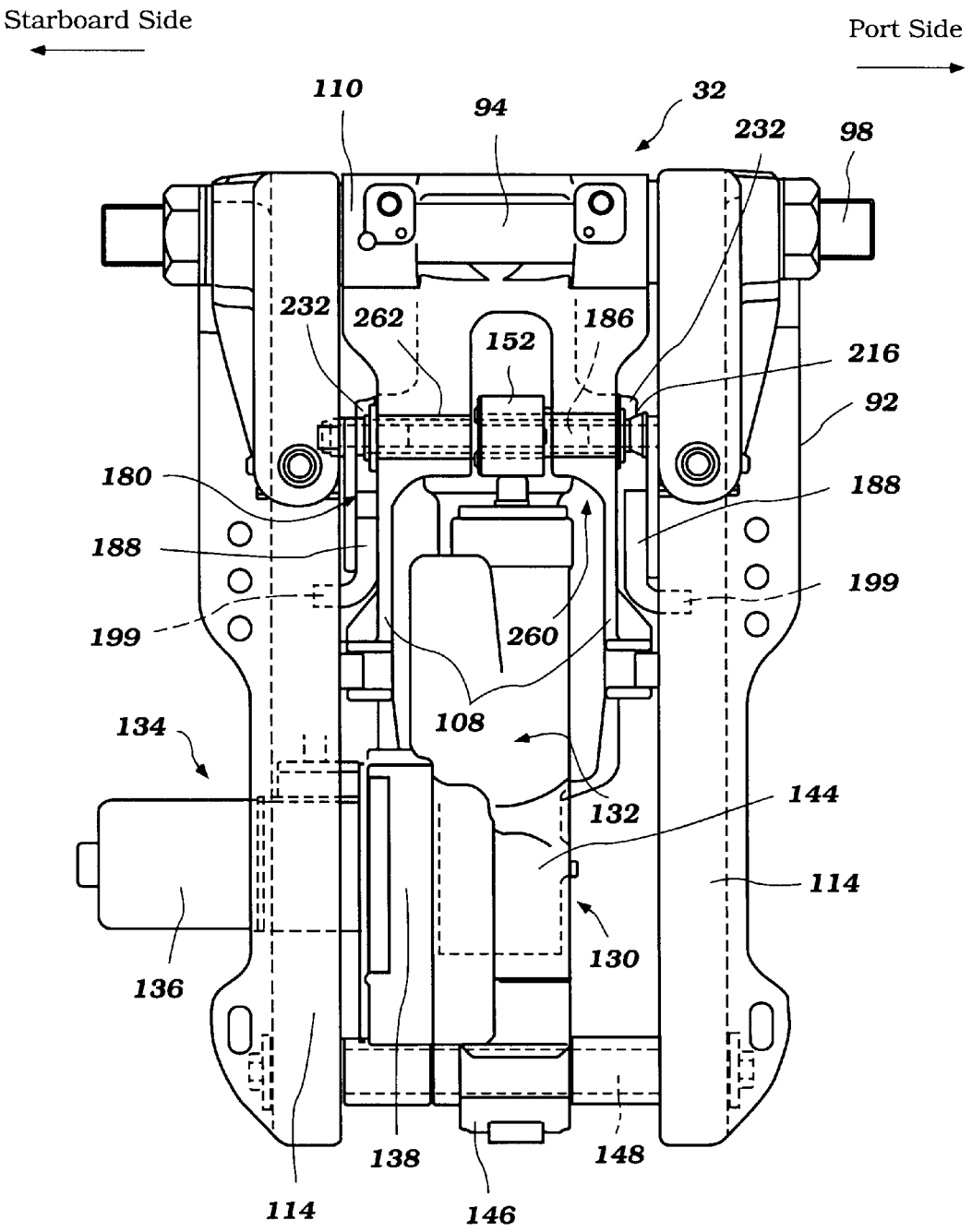
FIG. 11 is an enlarged front view of the support assembly shown in FIG. 10.
Figure 12:
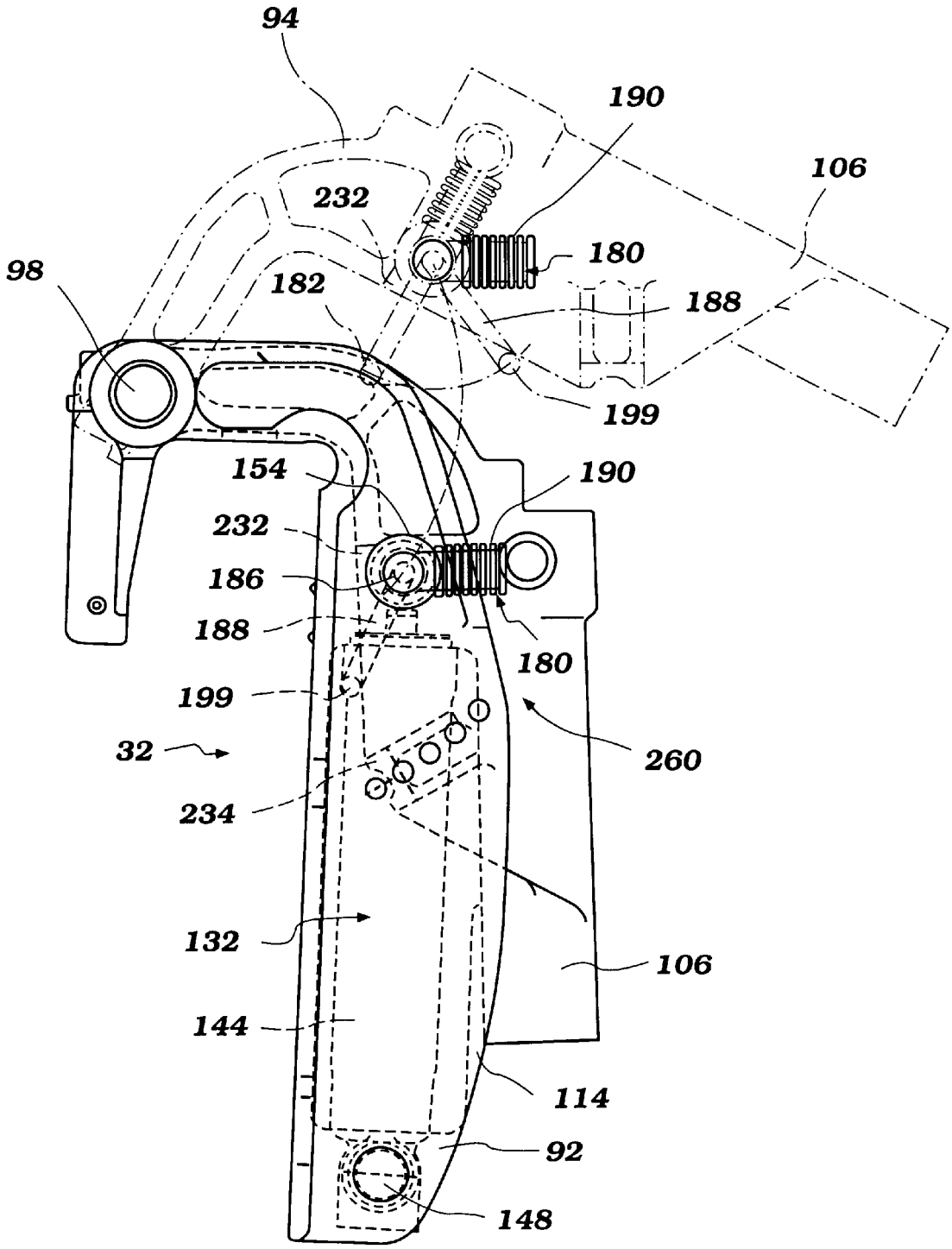
FIG. 12 is an enlarged side elevational view showing how the tilt stop member moves while the swivel bracket is shifted in a trim and tilt range in this embodiment. The support assembly in the tilted up position is illustrated in phantom line.

With reference to FIGS. 10 to 12, another tilt position holding device 260 arranged in accordance with another embodiment of the present invention will be described. The same elements, members and components that have been described in connection with the embodiment shown in FIGS. 1 to 9 will be assigned with the same reference numerals and not described repeatedly unless any need exist.

The fundamental construction of the tilt position holding device 260 is similar to the holding device 34 in the embodiment of FIGS. 1–9. A major difference between the devices 260, 34 is that the pivot axis of the pin portion 186 of the tilt stop member 180 in this embodiment is generally consistent with the pivot axis of the pivot pin 262 of the actuator rod 150. That is, the pin portion 186 is coaxially provided within the pivot pin 262. The pivot pin 262 is, therefore, not a solid but hollow member. As best seen in FIG. 10, the upper projection 232 in this embodiment is positioned higher than the upper projection 232 in the embodiment of FIGS. 1–9. The middle projection 184 in that embodiment is not provided in this embodiment.

Since the pin portion 186 is coaxially provided with the pivot pin 262, the tilt holding device 260 can be more easily incorporated within such a narrow space of the support assembly 32.

The swivel bracket does not necessarily have the position determining portion or projection that defines the operative position and the release position of the tilt stop member. However, if it is provided, positioning of the stop member can be more ensured.

The spring can be omitted, although it is helpful to retain the stop member at a certain position where it should be. In one alternative arrangement, an elastic member such as a rubber tube or bellows can replace the spring.

Various configurations other than the recess can be applied as the engage portion or holder portion of the clamping bracket. For instance, a pinch mechanism that pinches the stopper portion may be employed.

Of course, the foregoing description is that of preferred embodiments of the invention, and various changes and modifications may be made without departing from the spirit and scope of the invention, as defined by the appended claims.

What is claimed is:

1. A tilt position holding device comprising an outboard drive assembly and a support bracket adapted to be affixed to an associated watercraft, the support bracket comprising a pair of transversely spaced portions, at least a portion of the drive assembly being interposed between the spaced portions, the drive assembly having a projection extending laterally from a side surface of the drive assembly, the projection defining an operative position and a release position of a tilt stop member, a tilt pin coupling the drive assembly to the support bracket for pivotal movement about a tilt axis extending generally horizontally, and the device also comprising the tilt stop member adapted for pivotal movement about a pivot axis extending generally horizontally, the tilt stop member comprising at least one stopper portion extending between the drive assembly and the support bracket when the drive assembly is in a tilted down position, the support bracket comprising at least one engage portion, the stopper portion being engageable with the engage portion by the pivotal movement of the tilt stop member when the drive assembly is in a tilted up position, the operative and release positions of the tilt stop member respectively being defined opposite sides of the projection, the stopper portion being engageable with the engage portion when the tilt stop member is in the operative position and the tilt stop member being transversely moveable to surmount the projection for selectively positioning the stopper portion in the operative position or the release position.

2. A tilt position holding device as set forth in claim 1 further comprising means for biasing the tilt stop member to hold the stopper portion at the operative position or the release position.

3. A tilt position holding device as set forth in claim 2, wherein the biasing means include a spring.

4. A tilt position holding device as set forth in claim 1, wherein the tilt stop member additionally includes a pin portion pivotally coupled to the drive assembly, the stopper portion extends from the pin portion to generally form a crank configuration together with the pin portion.

5. A tilt position holding device as set forth in claim 1, wherein the tilt stop member additionally includes a grip portion.

6. A tilt position holding device as set forth in claim 1, wherein the engage portion includes a recess formed on the support bracket, and the stopper portion is fitted in the recess when the drive assembly is in the tilted up position.

7. A tilt position holding device as set forth in claim 1 additionally comprising an actuator nested between the spaced portions and arranged to tilt the drive assembly.

8. A tilt position holding device as set forth in claim 7, wherein the drive assembly includes a pair of second transversely spaced portions, and the actuator, at least in part, is disposed between the second spaced portions.

9. A tilt position holding device as set forth in claim 8, wherein the tilt stop member includes a pin portion with which the tilt stop member is supported by the second spaced portions for pivotal movement about a first pivot axis, and one end of the actuator is also supported by the second spaced portions for pivotal movement about a second pivot axis.

10. A tilt position holding device as set forth in claim 9, wherein the second pivot axis is generally consistent with the first pivot axis.

11. A tilt position holding device as set forth in claim 8, wherein the actuator includes a cylinder, a piston slidably supported within the cylinder, a piston rod affixed to the piston and extends beyond one end of the cylinder, and one of the cylinder and the piston rod is pivotally supported by the second spaced portions.

12. A tilt position holding device as set forth in claim 1, wherein the outboard drive assembly includes a drive unit and a swivel bracket, and the swivel bracket supports the drive unit for pivotal movement about a steering axis extending generally vertically.

13. A tilt position holding device as set forth in claim 1, wherein the engage portion is positioned between the tilt axis and a locus of the pivot axis of the tilt stop member defined when the drive assembly moves pivotally about the tilt axis.

14. A tilt position holding device for an outboard drive assembly comprising a support bracket adapted to be affixed to an associated watercraft, the support bracket including a pair of transversely spaced portions, at least a portion of the drive assembly being interposed between the spaced portions, a tilt pin coupling the drive assembly to the support bracket for pivotal movement about a tilt axis extending generally horizontally, and a tilt stop member coupled to the drive assembly for pivotal movement about a pivot axis extending generally horizontally, the drive assembly having a projection on its side surface, the projection extending laterally from the side surface, the tilt stop member including at least one stopper portion that is allowed to position at one of an upper side and a lower side of the projection, the support bracket having at least one holder portion, the stopper portion being engageable with the holder portion by the pivotal movement of the tilt stop member when the stopper portion is positioned at the upper side of the projection so that the tilt stop member holds the drive assembly in a tilted up position, the tilt stop member being transversely moveable to surmount the projection for selectively positioning the stopper portion at the upper side or the lower side of the projection.

15. A marine propulsion device comprising a drive unit, a support bracket adapted to be affixed to an associated watercraft, the support bracket including a pair of bracket arms, a tilt pin connecting the drive unit to the support bracket for pivotal movement about a tilt axis extending generally horizontally, an actuator connected between the drive unit and the support bracket for pivotal movement about a first pivot axis extending generally horizontally to tilt the drive assembly relative to the support bracket, and a tilt lock member connected to the drive unit for pivotal movement about a second pivot axis extending generally horizontally, the second pivot axis being generally consistent with the first axis, the tilt lock member including at least one lock portion, the support bracket having at least one holder portion, and the lock portion being engageable with the holder portion by the pivotal movement of the tilt lock member so that the tilt lock member locks the drive unit in a tilted up position.

16. A tilt position holding device for an outboard drive assembly comprising a support bracket adapted to be affixed to an associated watercraft, the support bracket comprising a pair of transversely spaced portions, at least a portion of the drive assembly being interposed between the spaced portions, a tilt pin coupling the drive assembly to the support bracket for pivotal movement about a tilt axis extending generally horizontally, a tilt stop member coupled to the drive assembly and capable of pivotal movement about a pivot axis extending generally horizontally, the tilt stop member having at least one stopper portion extending between the drive assembly and the support bracket when the drive assembly is in a tilted down position, the support bracket having at least one engage portion, the stopper portion being engageable with the engage portion by the pivotal movement of the tilt stop member when the drive assembly is in a tilted up position, and the engage portion being positioned between the tilt axis and a locus of the pivot axis of the tilt stop member defined when the drive assembly moves pivotally about the tilt axis.

17. A marine propulsion device comprising a drive unit, a support bracket adapted to be affixed to an associated watercraft for supporting the drive unit, the support bracket including a pair of transversely spaced portions, at least a portion of the drive unit being interposed between the spaced portions, the drive unit having a projection extending laterally from a side surface of the drive assembly, a tilt pin coupling the drive unit with the support bracket for pivotal movement about a tilt axis extending generally horizontally, and a tilt stop member coupled with the drive unit and adapted for pivotal movement about a pivot axis extending generally horizontally, the tilt stop member having at least one stopper portion extending between the drive unit and the support bracket when the drive unit is in a tilted down position, the support bracket having at least one engage portion, the stopper portion being engageable with the engage portion by the pivotal movement of the tilt stop member when the drive unit is in a tilted up position, the projection defining an operative position and a release position of the tilt stop member, the operative and release positions severally existing on each side of the projection, the stopper portion being engageable with the engage portion when the tilt stop member is in the operative position, and the tilt stop member being transversely moveable to surmount the projection for selectively positioning the stopper portion in the operative position or the release position.

18. A marine propulsion device as set forth in claim 17, further comprising a bias mechanism arranged to urge the tilt stop member to hold the stopper portion at the operative position or the release position.

19. A marine propulsion device as set forth in claim 17, wherein the engage portion includes a recess formed on the support bracket, and the stopper portion is fitted in the recess when the drive unit is in the tilted up position.

20. A marine propulsion device comprising a drive unit, a support bracket adapted to be affixed to an associated watercraft for supporting the drive unit, the support bracket including a pair of transversely spaced portions, at least a portion of the drive unit being interposed between the spaced portions, a tilt pin coupling the drive unit with the support bracket for pivotal movement about a tilt axis extending generally horizontally, and a tilt stop member coupled with the drive unit for pivotal movement about a pivot axis extending generally horizontally, the tilt stop member having at least one stopper portion extending between the drive unit and the support bracket when the drive unit is in a tilted down position, the support bracket having at least one engage portion, the stopper portion being engageable with the engage portion by the pivotal movement of the tilt stop member when the drive unit is in a tilted up position, and the engage portion being positioned between the tilt axis and a locus of the pivot axis of the tilt stop member defined when the drive unit moves pivotally about the tilt axis.

* * * * *